United States Patent [19]

Peil

[11] 4,118,689

[45] Oct. 3, 1978

[54] SMOKE DETECTOR

[75] Inventor: William Peil, Syracuse, N.Y.

[73] Assignee: General Electric Company, Syracuse, N.Y.

[21] Appl. No.: 746,293

[22] Filed: Dec. 1, 1976

[51] Int. Cl.[2] ..... G08B 17/10

[52] U.S. Cl. ..... 340/629; 250/381

[58] Field of Search ..... 340/237.5; 250/381, 250/382, 384, 385, 389

[56] References Cited

U.S. PATENT DOCUMENTS 3,516,083 6/1970 Myer ..... 340/237.5

*Primary Examiner*—John W. Caldwell, Sr.

*Assistant Examiner*—Daniel Myer

*Attorney, Agent, or Firm*—Richard V. Lang; Carl W. Baker; Frank L. Neuhauser

[57] ABSTRACT

A smoke detector comprising a smoke detection cell of the ionization type and an electrical network which provides for ac operation of the detection cell. The impedance of the smoke detection cell is very high (40,000 megohms) and changes in the presence of airborne combustion products. The network senses the impedance change by a measurement of the current through the chamber assuming an ac source under a short circuit load condition, a technique facilitating the use of bipolar transistors.

19 Claims, 5 Drawing Figures

SMOKE DETECTOR

BACKGROUND OF THE INVENTION

1. Field of the Invention

The present invention relates to smoke detectors employing detection cells of the ionization type, and to the associated electrical circuitry for operation of the detection cell and for sensing the electrical changes which occur in the presence of airborne combustion products:

2. Description of the Prior Art

A smoke detection cell of the ionization type and circuits for dc operation of the detection cell are described in patent applications of Robert J. Salem, Ser. No. 630,204, filed Nov. 10, 1975, entitled "Smoke Simulating Test Apparatus for Smoke Detectors" and Ser. No. 630,202, filed Nov. 10, 1975, entitled "High Gain Sensing and Switching Means for Smoke Detectors", and assigned to the Assignee of the present application.

A smoke detection cell of the ionization type suitable for use in the present application is described in said applications. It includes an alpha particle radiation source, such as a small quantity of Americium 241, in a measuring chamber having positive and negative electrodes. The measuring chamber ionizes the air between the electrodes, permitting the flow of a small electrical current when a dc voltage is applied across the electrodes. When airborne products of combustion (smoke) enter the measuring chamber, an increase in resistance to the flow of current is observed. The resulting change in the electrical conductivity of the measuring chamber is sensed and used to trigger an alarm when the change exceeds a given quantity. The latter quantity is selected to correspond to a level of smoke or aerosols within the measuring chamber representing a dangerous condition.

A smoke detector which provides for ac operation for the detection cell is described in the patent application of Joseph P. Hesler, Ser. No. 728,524, filed Oct. 1, 1976, entitled "Smoke Detector", and assigned to the Assignee of the present application. In that application, the change in detection cell impedance in the presence of airborne combustion products alters the operating frequency of the network. The frequency change is sensed to actuate the alarm. The network utilizes MOSFET devices as the active circuit elements.

Electrical conductivity of the measuring chamber is sensed in said patent applications by measurement of the voltage across the measuring chamber. In the open-circuit voltage measurement process, which the Hesler application employs, the measurement network should retain a high impedance in respect to that of the detection cell. With FET devices this is typically $10^{12}$ ohms, a figure which is one and two orders greater than the impedance ($4 \times 10^{10}$ ohms) of the cell. Under ideal conditions, this factor is quite adequate for accurate measurements. In the presence of moisture in the air or surface contamination, these impedances may change enough to affect the measurement accuracy. If an ac measurement is made, the problem of maintaining small capacitances at a stable value may also be present.

SUMMARY OF THE INVENTION

It is an object of the present invention to provide an improved smoke detector employing an ionization type detection cell.

It is a further object of the present invention to provide an improved smoke detector in which ac measurement of the impedance of the detection cell is employed.

It is another object of the invention to provide an improved smoke detector in which ac measurement of the impedance of the detection cell is employed and in which changes in input impedance of the measuring network do not affect accuracy.

It is still another object of the invention to provide an improved smoke detector employing an ionization type detection cell having improved temperature compensation.

These and other objects of the invention are achieved in a novel smoke detection network comprising an ionization smoke detection cell and a sensing circuit. The network has a common terminal to which the sensing circuit is connected. The ionization smoke detection cell has a first and a second terminal between which a high impedance exists, the impedance rising when airborne combustion products are present. The sensing circuit senses a change in chamber impedance by a measurement of the ac short circuit current through the chamber. The sensing circuit comprises an ac voltage source, a current amplifier and a voltage responsive means. The ac source has one terminal connected to the first chamber terminal and the other terminal connected to the network common terminal. The current amplifier, preferably employing bipolar transistors, has an input, an output and a common terminal and exhibits an input impedance which is negligibly small in respect to the chamber impedance. The amplifier input terminal is coupled to the second chamber terminal; the amplifier common terminal is coupled to the network common terminal, and an amplifier load is coupled between the amplifier output terminal and the amplifier common terminal. An amplified ac current appears in the amplifier load as an ac voltage whose magnitude is dependent on chamber impedance and in turn on the density of airborne combustion products present. The voltage responsive means is coupled to the amplifier output terminal for sensing the density of airborne combustion products.

In a preferred form, the ac source is constituted by the current amplifier to which a regenerative feedback network is added, the amplifier output terminal being connected to the first chamber terminal to couple ac oscillations to the chamber.

In accordance with another aspect of the invention, the chamber is connected in the regenerative feedback network. This permits an oscillatory condition to be established when the chamber is in a lower impedance state, corresponding to a low density of airborne combustion products and a non-oscillatory condition, or one in which the oscillation amplitude is reduced, to be established when the chamber is in a higher impedance state, corresponding to a predetermined higher density of airborne combustion products.

In a first embodiment of the invention, the current amplifier comprises a first transistor in base input configuration, and a second transistor whose base input is derived from the collector output of the first transistor. The emitter of the second transistor is returned to ground through an ac path including a first impedance ($R_f$), and its collector is returned to a bias supply through a second impedance ($R_L$). The feedback network is associated with these impedances. It includes a degenerative feedback path comprising a large valued resistance ($R_i$) coupled between the emitter of the second transistor and the input base of the first transistor.

The regenerative ac feedback path includes the chamber impedance ($R_g$) coupled between the output collector of the second transistor and the input base of the first transistor. Sufficient degeneration is provided to make the amplifier gain independent of transistor device parameters and, with a high degree of accuracy, dependent on the four impedances: $R_{(f)}$, $R_{(L)}$, $R_{(i)}$ and $R_{(g)}$. The impedances are given values which satisfy the following gain establishing relationship:

$$\frac{R_i}{R_g} \times \frac{R_L}{R_f} = 1 + \epsilon$$

where $\epsilon$ is selected to insure an oscillatory condition at a predetermined amplitude under normal, low impedance conditions.

The first embodiment also includes a current source comprising a third transistor for supplying collector current to the first transistor and providing a high impedance load to enhance amplifier gain. In normal operation, the collector of the second transistor tends to saturate at one limit of the oscillatory cycle, causing a peak in base current. A fourth transistor is provided as a buffer and for supplying base current to the second transistor. Oscillation parameters are sensed by coupling the voltage responsive means to the collector of the fourth transistor.

In the same first embodiment, a fifth transistor is provided for cascading the first transistor. The fifth transistor reduces amplifier input noise and the base current of the first transistor to the sub-nanoampere range for increased sensitivity.

The voltage responsive means of the first embodiment comprises a capacitor, means for discharging the capacitor at a predetermined rate, charging means, and a voltage sensor having a threshold. The charging means is capable of charging the capacitor at a rate exceeding the discharge rate when oscillations take place exceeding the threshold. The arrangement causes the capacitor voltage to assume a high value under normal oscillation and a low value in the absence of oscillation. A warning signal is generated when the capacitor becomes discharged to the low value.

The second embodiment employs the first three transistors earlier characterized and adds successive refinements. A fourth transistor is added cascode connected to the first transistor for increased gain and for greater insensitivity to leakage current. The current source is cascoded to provide a higher impedance load to the cascoded amplifier for enhanced forward gain. A first clamp circuit is provided to prevent saturation of the upper cascoded stage. A sixth transistor is provided as a buffer preceeding the second transistor.

In addition, the second embodiment has a second clamp circuit for preventing saturation of the second transistor comprising a third diode and the input junction of a seventh transistor. The voltage responsive means of the second embodiment is coupled to the collector of the seventh transistor for sensing base current peaks in the second transistor accompanying oscillation.

BRIEF DESCRIPTION OF THE DRAWING

The novel and distinctive features of the invention are set forth in the claims appended to the present application. The invention itself, however, together with further objects and advantages thereof may best be understood by reference to the following description and accompanying drawings, in which:

DESCRIPTION OF PREFERRED EMBODIMENTS

Figure 1:
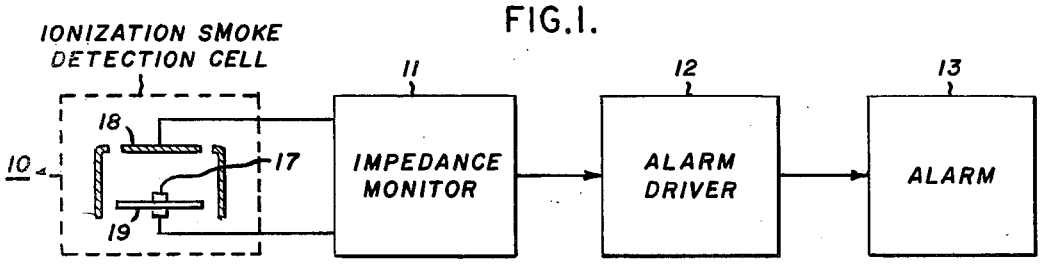
FIG. 1 is a block diagram of a novel smoke detector in which an ionization type smoke detection cell is connected into an electrical network. The network monitors smoke induced changes in resistance in the smoke detection cell, and gives an alarm when smoke is indicated.

FIG. 1 is a block diagram showing the principal elements of a smoke detector. The smoke detector is an electrical network comprising an ionization type smoke detection cell 10, an impedance monitor 11, embodying the invention, an alarm driver 12, and an alarm 13. When suitably electrically energized, the detection cell exhibits an increase in impedance in the presence of smoke.

The novel impedance monitor 11 is coupled to the detection cell and senses any changes in impedance of the detection cell in the presence of smoke. If the impedance has increased beyond a specified limit, corresponding to a given smoke condition, the impedance monitor produces an output signal which is coupled to the alarm driver 12. The output signal of the monitor actuates the driver whose output is coupled to the alarm 13, causing it to operate.

The smoke detection cell 10 is of known design and works upon the ionization principle. Suitable detection cells are described in the two copending patent applications of Robert J. Salem mentioned above. A suitable detection cell includes a source 17 of $\alpha$ particle radiation, typically a 1 to 4 microcurie source of Americium 241 installed in a measuring chamber. The chamber is defined by a pair of mutually insulated metallic members 18 and 19, which also establish an alternating electric field within the chamber in the region exposed to $\alpha$ particle radiation. The upper member 18 is a partial cylinder comprisng a flat top and a cylindrical side wall. The tp contains perforations around the perimeter to permit a free flow of air including any airborne products of combustion through it into the interior of the chamber. The opening at the bottom of the upper member is partially closed by the lower member 19. The lower member 19 is a circular disc, installed within the upper member to complete the generally closed cylindrical measuring chamber. Thelower member 19 is of lesser diameter than the cylindrical side wall of the upper member 18, so as to provide electrical insulation and to leave a circular opening around the bottom of the chamber for facilitating air flow into the chamber. The two openings are designed to permit a free exchange of ambient air with that within the chamber. The chamber defined by members 18 and 19 is typically 4 centimeters in diameter and 0.75 centimeters in height. The Americium source 17 is on a 4 millimeter diameter wafer installed on a slightly elevated pedestal at the center of the lower member 19. Finally, each member 18 and 19 has a terminal designed to be connected to a source of voltage. When so connected the unperforated central portion of the upper member 18 and the lower member 19 form two parallel plates establishing a generally uniform electric field parallel to the axis of the cylinder in the air surrounding the Americium source.

The smoke detection process entails the active source of radiation, normally $\alpha$ particles; the presence of an electric field in the region around the source; and means to sense the electrical change which takes place in the detection cell when smoke or other products of combustion are present in the chamber. As noted, the observed electrical change is a change in electrical impedance in the detection cell. The absolute current in the detection cell normally lies in the range of 10–500 microamperes at voltages of less than 50 volts and the impedances are on the order of 40,000 megohms. The operating properties of the smoke detection cell will now be discussed with a view toward further specifying the requirements of the associated network.

Ordinary air is a quite good insulator, particularly at low fields. Assuming that a small electric field is established within a detection cell in which the radioactive source is absent, one encounters only very tiny currents, normally less than a picoampere ($10^{-12}$ amperes). While ordinary air is not a perfect insulator, a small number of ionized particles are frequently present, and these may be impelled under the influence of the field toward one or the other of the electroes and support a small current. The current is small because the ionic motion is random and recombination neutralizes many ions before impingement on either electrode. At higher fields than of concern here, air will break down and support a high current discharge.

When a source of $\alpha$ particles is present, a detection cell becomes clearly conductive at low fields. The ionization smoke detector is operated at electrical fields in the linear region below the strength required to produce either saturation or electron multiplication.

Figure 2:
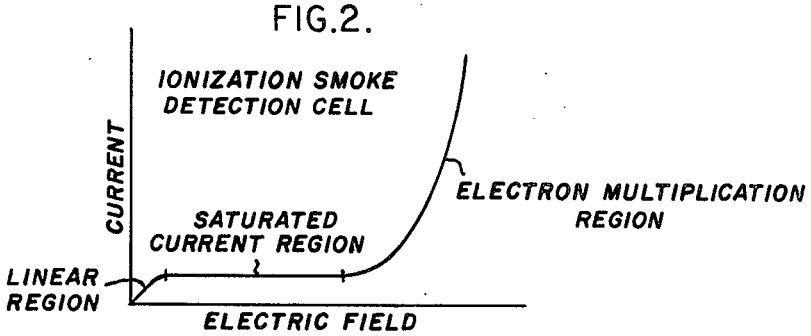
FIG. 2 is a graph illustrating the current of a representative ionization type smoke detection cell under differing electrical field conditions.

A graph of the conduction phenomenon of a representative detection cell is shown in FIG. 2. It exhibits three regions, distinguished by three ranges of electric field strengths. In the first or low field region, the current is small but detectable and increases approximately linearly with increasing field. This current arises from ions created by the $\alpha$ particles. The particles emitted by the Americium source 17 are highly energetic (5.5 Mev), and assuming normal atmospheric pressures, each $\alpha$ particle will collide with large numbers of molecules in the surrounding gas to form ions. A single $\alpha$ particle at an average energy loss of 35 ev per collision has sufficient energy to create $10^5$ ions, and will lose much of its energy in this manner in the chamber. The usual inelastic collision strikes off a single electron leaving a positively charged singly ionized gas molecule. In air, the positively ionized molecule is usually nitrogen. The free electron has a short lifetime in air and quickly attaches itself to an oxygen molecule (usually) and creates a negatively charged gas molecule. All the ions exhibit average thermal velocities ($\sim 10^4$ cm/sec) which are much larger than the 1.8 cm/sec per volt/cm velocities imparted by low electrical fields. If the electrical field between the electrodes is small, the velocity imparted to a charged gas molecule in the direction of the collecting electrodes is small and the time available for recombination before impingement on an electrode is maximum, being set primarily by the thermal energy. As the electric field increases, the velocities imparted by the field in the direction of the electrodes become more significant to relation to the thermal velocities, gradually reducing the average time before an ion impinges on an electrode, and eventually causing a substantial reduction in the amount of time available for ionic recombination. In the low field region, ionic current increases approximately proportionally with the field.

The second and third conductive regions of FIG. 2 are called the saturation and electron multiplication region. These regions are avoided in operation of the detection cell. At higher fields, the ions are given a high velocity by the fields in the direction of the collecting electrodes. This means that most ions introduced into the chamber are collected in a very short time, and that the negative ions go to the positive electrodes, and the positive ions to the negative electrodes. Under these conditions, ionic recombinations become negligibly small and substantially all ions are collected separately and contribute to the current flow. When this occurs, the current reaches a plateau region where further increases in field produce only slight increases in current. The lower boundary of the "saturation" region occurs at about 100 volts per cm. The upper boundary of the saturation region is set at the region where the field becomes strong enough to accelerate free electrons to a sufficient velocity to create additional ions in the air. Electron multiplication is the characteristic of the third conduction region.

When smoke is introduced into a chamber, assuming a suitable level of radiation and a suitable electrical field (below saturation and below electron multiplication), the ionization current is reduced and the electrical impedance increased. This is normally explained as due to smoke induced ionic recombination. When recombination occurs, an ion is neutralized before impact on the collecting electrode and any deposition of charge on the electrode is prevented. The particles of smoke are believed to provide sites for recombination of the gaseous ions and therefore the observed reduction in current in the presence of the smoke is attributed to this phenomenon.

The smoke induced recombination explanation depends upon the following assumptions and is generally assumed to be the correct one. The particles of smoke are massive in comparison to the gas molecules. Because of their size, they are slow moving under thermal effects. Their motion is essentially unaffected by the low electric field in the detection cell because of their size and low charge. When a gaseous ion strikes a smoke particle, a high probability exists for neutralization of the gaseous ion and a transfer of charge to the smoke particle. A 1 micron smoke particle may be expected to be struck about $10^{16}$ times per second by a gas molecule. Assuming an equal chance for impact by positive or negative ions and a large number of impacts, the net charge on a given smoke particle may be expected to remain near zero.

The recombination effect can be substantial. In a chamber of a few cubic centimeters in volume, the total number of gas molecules may be $10^{20}$. Assuming a reasonable number of smoke particles, i.e., $10^4$ or more, one may expect most of the gas molecules to strike a smoke particle once per second, and most to lose their charge in the collision. In short, there will be enough ionic impacts with the smoke particles to neutralize a substantial percentage of ions and thus produce a substantial effect upon the conduction of the cell. In practice, most smoke detectors respond to from 1 to 4% smoke (i.e., smoke which reduces light transmission over a distance of a foot by 1 to 4%). The change in conduction at which the alarm is actuated is generally between 5 and 30%.

The ionization smoke detector is operated in the low field region, well below the saturation region. The preferred field lies between 5 and 15 volts, and with typical radioactive sources, the normal current level lies between 30 and 300 picoamperes. Lower electric fields than these show greater sensitivity to smoke, but also a greater likelihood of false triggering. The indicated choice represents a compromise between maximum sensitivity to smoke and a desired insensitivity to small changes in air velocity, and certain other effects which could produce false alarms.

Figure 3:
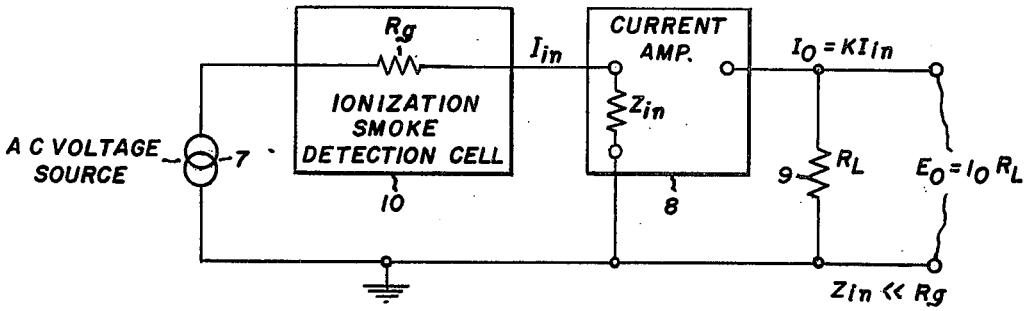
FIG. 3 is a block diagram illustrating the principle of ac short circuit current measurement used to monitor the impedance of the smoke detection cell.

FIG. 3 is a simplified block diagram illustrating the network by which the impedance of the ionization smoke detection cell is monitored. The network is of high sensitivity in that it can detect small percentages of smoke with high reliability. In accordance with the invention, the impedance measurement is based on an ac measurement of the short circuit current of the ionization smoke detection cell.

As shown in FIG. 3, the network includes an ac voltage source 7, the ionization smoke detection cell 10, a current amplifier 8, and a load 9. The ionization smoke detection cell is shown as a two terminal device, not itself grounded, having a first and a second terminal between which a very large resistive impedance ($4 \times 10^{10}$ ohms) appears. The ac voltage source 7 has one terminal coupled to the input terminal of the detection cell and the other terminal coupled to a common network terminal or ground. The output terminal of the ionization smoke detection cell is coupled to an input terminal of the current amplifier 8.

The current amplifier 8 is illustrated as a three terminal device having an input terminal, an output terminal, and a common terminal. The input impedance ($Z_{in}$) is illustrated within the block as existing between the input terminal and the common terminal of the current amplifier. The exact value of the input impedance is unimportant so long as it is small enough. It should be substantially less than the impedance ($4 \times 10^{10}$ ohms) of the ionization chamber to provide an accurate short circuit current measurement, unaffected by changes in ($Z_{in}$) of the amplifier. A value of 22 megohms ($2.2 \times 10^7$) is typical and in less than 1/10 of 1% of the chamber impedance. At the amplifier output terminal, a current $I_o$ is produced:

$$I_o = KI_{in}$$

where $K$ is the amplification of the current amplifier (typically 66 db). The output terminal of the current amplifier 8, at which the current $I_o$ appears, drives the load 9 having a resistance $R_L$. The output voltage ($E_o$) produced is:

$$E_o = I_o R_L$$

The problem of gain stability with temperature is particularly acute because the gain must be both high and precise. The currents available from the ionization chamber lie in the range of $30 - 300 \times 10^{-12}$ amperes. The current gain required to make the voltage output from the amplifier equal to the ac source voltage across the chamber is 40,000 m ohms/20 m ohms or 2000 (i.e. 66 db). This gain requirement fulfills the criterion for unity gain in the event that the chamber becomes a serial feedback element from amplifier output to input. This sets a practical current gain requirement for the amplifier. In the case of 4% smoke, i.e., smoke which reduces light transmission 4% in 1 foot of travel, the electrical effect in an ionization chamber is a 16% change in current. This electrical change is less than 2 db. Similarly, if a sensitivity of 2% smoke is desired, the current change is less than 1 db. Finally, if a 1% smoke sensitivity is desired, the change in current is less than 1/5 db. This last is a common practical requirement. In short, a gain of 66 db with an accuracy of less than 1/5 of 1 db is required to permit smoke measurement to an accuracy of 1% "smoke". In a temperature range of from 0° to 50° C, the $\beta$'s of the individual transistors may change 10% to bring a net change of 30% for three gain stages. The 30% change in $\beta$ corresponds to approximately 3 db. To reduce that error in gain from 3 db to 0.03 db (a 100 fold reduction in gain variation), a degenerative feedback network expending 40 db of gain must be employed. With suitable excess gain, the feedback network impedances establish the amount of amplifier gain, and the amount of degeneration establishes the accuracy with which that gain is maintained against variation in parameters. Since 66 db of gain are needed to produce the requisite current gain and 40 db are needed for degenerative gain correction, the amplifier requires a total of 104 db of gain. This amount of gain is available from three stages of current gain, assuming minimum transistor $\beta$'s of 100 and proper amplifier design.

AC current measurements as herein contemplated provide an immunity to dc leakage currents that would ordinarily preclude dc operation with bipolar transistors. Typical signal levels from a 3.6 $\mu$ curie ion chamber are $$\frac{8 \text{ volts}}{40{,}000 \times 10^6} = 2 \times 10^{-10} \text{ ampere p} - \text{p.}$$

The leakage current of the transistor in the earliest gain stage has the primary effect on the output circuit. Typical leakage currents for an IC bipolar transistor are $0.2 \times 10^{-9}$ amperes at 0° C increasing tenfold to $2 \times 10^{-9}$ amperes at 50° C. If dc measurements were employed, this amount of drift would preclude the use of bipolar transistors. In the present circuit, the drift shows up as a 4 millivolt offset in the voltage at the output stage. Since the amplifier is designed for ac gain, this drift is small enough not to affect operation, unless it is made to change rapidly, and it need not be specially compensated.

A final temperature dependent element is the chamber impedance itself. The chamber is found to exhibit a change in resistance of about 2000 ppm per degree centigrade. In a 50° C range, this amounts to a 10variation in resistance. A 10% variation is greater than the 8% variation in resistance which 2% smoke produces, making temperature compensation mandatory. Compensation is accomplished in one practical embodiment by use of an IC processed resistor in the feedback network having a comparable temperature coefficient of opposite sign.

The bipolar IC transistors herein described have an adequate signal to noise requirement for smoke detection. A noise variation of 1/10 of 1% would produce a negligible variation in the amplitude. While such performance is not readily available, the observed $1/f$ noise using conventional bipolar IC transistor causes approximately a 1% (40 db signal to noise ratio) gain change equivalent in threshold amplitude.

Figure 4:
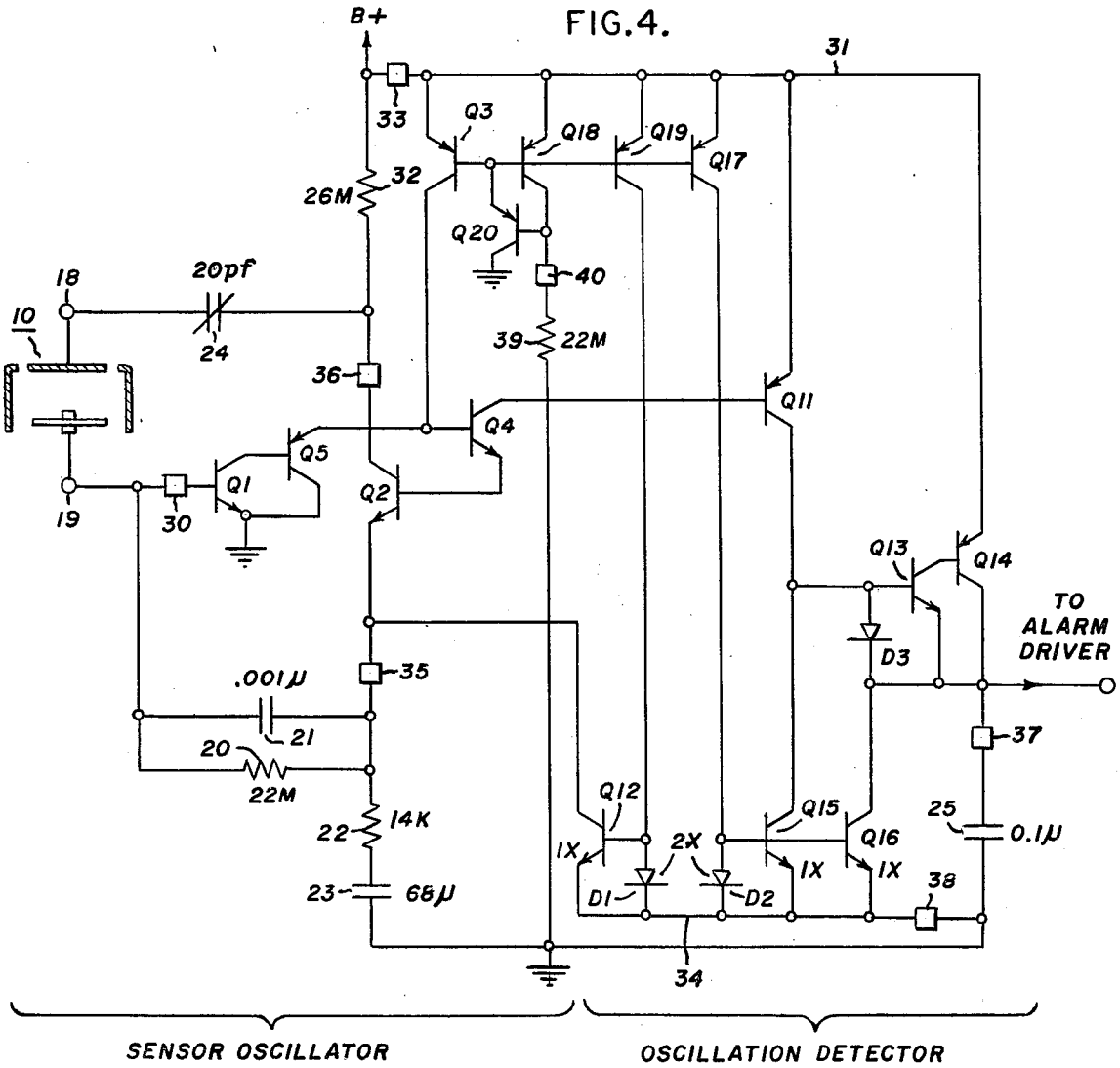
FIG. 4 is an illustration of a first embodiment of the invention showing the electrical circuit details.

FIG. 4 shows a first embodiment of the invention. It includes a novel impedance monitor 11 in circuit with the ionization type smoke detection cell. In accordance with the invention, the impedance monitor employs bipolar active circuitry fabricated using conventional silicon integration techniques and designed for low current drain. The impedance monitor comprises a sensor oscillator of which the smoke detection cell is an electrical element and an oscillation detector.

The sensor oscillator consists of an amplifier of high forward gain consisting of the transistors Q1, Q5, Q4 and Q2, a degenerative feedback path, consisting of the passive components 20 to 23, a regenerative feedback path including the ionization chamber 10 and a capacitor 24, and appropriate biasing means. As will be explained, the forward gain and feedback parameters are adjusted to give a net gain in excess of one in the normal condition that smoke is absent and cause oscillation. When smoke is present, the net gain drops below one and oscillations cease.

The sensor oscillator is connected as follows. The forward gain path is from transistor Q1 to Q5 to Q4 to Q2. The input transistor Q1 is in a high current gain base input, emitter common configuration. Transistor Q1 is an NPN transistor integrated on the semiconductor substrate, having its base coupled through pad 30 on the margin of the substrate to the terminal 19 of the smoke detection cell. This connection introduces any smoke induced changes in impedance or regenerative currents in the forward gain path. The emitter of Q1 is grounded, and its output, appearing at its collector, is coupled to the base of the laterally diffused PNP transistor Q5 for cascading. The collector of Q5 is grounded, and its emitter, at which the signal output appears, is coupled to the base of the third cascaded stage transistor (Q4). Current source Q3 which is connected to the Q5–Q4 interconnection, is a laterally devloped PNP transistor energized from the B+ bus 31. Current source transistor Q3 accordingly supplies base current to Q4, emitter current to Q5, and via the base current of Q5, collector current to Q1. Even absent Q5, the load impedance of the current source Q3 is very high permitting high gain operation if no other loading is present. The cascaded second stage Q5 adds to the gain and reduces the base current requirements of Q1 to the sub-nanoampere range for accomodation to the high impedance of the smoke detection cell.

Continuing with the forward gain path of the sensor oscillator, the third and fourth stages of signal gain are provided by NPN transistors Q4 and Q2 respectively. Transistor Q4 is a buffer between Q5 and the last gain stage Q2, and provides both additional gain and a means of providing an isolated output for indicating an oscillatory state. The collector current for transistor Q4 is supplied from the base of laterally developed PNP transistor Q11. The emitter of Q11 is coupled to the B+ bus and its collector is coupled, as will be described, to the oscillation detector. The emitter of buffer Q4 is connected to the base of transistor Q2 to provide base current and signal. Transistor Q2 derives its emitter current from the collector of current source transistor Q12, whose emitter is grounded to bus 34 on the substrate. The emitter of Q2 is also coupled to the pad 35 at the margin of the semiconductor substrate where the external, or non-integrated, degenerative feedback impedances are connected. The collector of Q2 is connected to the pad 36, to which the collector load resistance 32 is connected and from which the external regenerative feedback connection originate. The other terminal of load resistance 32 is coupled to the B+ pad 33.

As previously indicated, the feedback network reduces the high forward gain of the sensor oscillator to near unity and the oscillatory condition is made dependent upon the state of impedance of the smoke detection cell in which regenerative feedback current flows. The degenerative feedback network comprises a first 22 megohm resistor (20) shunted by a 0.001 microfarad capacitor 21 and connected between the output emitter of Q2 at pad 35 and the input base of Q1 at pad 30. A 14K resistance 22 and a 68 microfarad capacitor 23 are coupled in series between pad 35 and an external ground.

The regenerative feedback path comprises a 56 picofarad variable air dielectric capacitor connected in series with the smoke detection cell 10. The capacitor 24 is connected between the collector pad 36 and the terminal 18 of the cell. The terminal 19 of the detection cell is coupled to the base input pad 30. In the overall circuit, the forward voltage gain is about 104 db. When feedback is taken into account, the gain may be approximated as follows:

$$\text{Gain} = \frac{R_i}{R_g} \times \frac{R_L}{R_f}$$

where $R_i = R_{20}$; $R_L = R_{32}$, $R_f = R_{22}$ and $R_{20}$, $R_{32}$, $R_{22}$ are the values of the designated resistors (in FIG. 4) and $R_g$ is the resistance (40,000 megohms) of the smoke detection cell. Substituting:

$$\text{Gain} = \frac{22 \times 10^6 \times 26 \times 10^6}{40 \times 10^3 \times 10^6 \times 14 \times 10^3}$$

$$= \frac{572}{560} = 1.02$$

A glance at the equations shows that if the impedance of $R_g$ is increased by 2% that the gain of the network will no longer exceed unity, and the oscillations may be expected to cease. The variable capacitor 24 is esigned to establish the precise point at which oscillations will be generated by the presence of a given smoke concentration.

The oscillation detector senses when the oscillator stops and indicates when the impedance of the smoke detection cell has fallen a prescribed amount corresponding to a given smoke concentration. As previously noted, the amplifier Q1, Q5, Q2, Q4 oscillates under normal, non-smoke conditions. In oscillating, the output transistor Q2 swings between cut-off and saturation. At cut-off, the collector voltage of Q2 reaches a maximum, doing so with a diminishing current. At saturation, the collector voltage of Q2 approaches ground potential, and as the collector junction approaches forward bias, forward conduction may occur, "clipping" the lower extremity of the collector voltage waveform and producing a succession of momentary base current pulses. The buffer stage Q4, which supplies the base drive for Q2, experiences current increases simultaneously with Q2, and current pulses appearing at the collector of Q4 are sensed, as will now be described, to detect oscillation.

The oscillation detector comprises the transistor Q11 and Q13 to Q17, diodes D2 and D3, and capacitor 25. The detector produces an output voltage across capacitor 25 which is near B+ when oscillations are present and a near zero output voltage if oscillations should cease. A zero output voltage is used to turn on the alarm driver 12 and generate an alarm signal.

The circuit of the oscillation detector is as follows. The transistor Q11 at the input of the detector is a laterally developed PNP transistor, having its base coupled to the collector of Q4 for sensing oscillation, its emitter coupled to the B+ bus 31, and its collector coupled to the collector of NPN current source transistor Q15 for energization. The base of current source transistor Q15 is connected to the anode of a diode connected transistor D2, and to the base of a second NPN transistor current source Q16. The collector of Q16 is connected to the pad 37. The cathode of diode D2, and the emitters of current source transistors Q15 and Q16 are grounded. The current levels in Q15 and Q16, as will be further detailed below, are set with reference to the current in diode D2. The current in diode D2 is set by the current source transistor Q17 whose collector is coupled to the cathode of D2, whose emitter is coupled to the B+ bus 31, and whose base is coupled to the primary current reference for the network. The bases of Q3, Q17, Q18 and Q19 are connected to this reference. Suffice it to say that the current supply network establishes a fractional (0.36 ) microampere current in diode D2, and currents of half that size (0.18 microamperes) in current source Q15 and Q16. The capacitor 25 is coupled between the pad 37 (to which the collector of transistor Q16 is connected) and the pad 38, tied to the internal ground bus 34. Assuming that Q16 is allowed to conduct a 0.18 microampere current, as preset by the current biasing network, and is not overriden by current supplied by parts of the oscillation detector not yet described, it will continuously discharge the capacitor 25, until it reaches a voltage near ground potential. (In the event that the base potential of Q16 is reduced, as by saturation of Q15, capacitor discharge will also take place, but at a reduced rate.)

When oscillation takes place, the capacitor 25 is not allowed to discharge but rather charges to a potential near B+. This result is reached by the circuit elements Q11, D3, Q13 and Q14 which are capable of charging the capacitor at a greater rate than the discharge rate produced by Q16. The signal output from the collector of Q11 is coupled to the base of NPN transistor Q13, whose emitter is coupled to the pad 37, and whose collector is coupled to the base of PNP transistor Q14. The input junction of Q13 is shunted by a diode connected transistor D3, poled in the forward direction. The emitter of Q14 is coupled to the B+ bus. The collector of Q14 is coupled to the emitter of Q13 and the pad 37 completing the interconnection of Q13, Q14 and the capacitor charging circuit. The interconnection between diode D3 and Q13 forms a turnaround of the current from Q11 into the base of Q14. Transistor Q14 provides a capacitor charging current substantially in excess of the discharge current produced by Q16.

The capacitor charging circuit charges the capacitor 25 when the current threshold established by transistor Q15 has been exceeded, a condition which only occurs during oscillation. Assuming that the current in Q11 is below the threshold current (0.18 microamperes) set into Q15, the voltage applied to the base of Q13, Q14 is held at ground potential by transistor Q15 which is saturated. Transistor Q15 is held in saturation by collector current starvation in the presence of a forward bias applied to its input junction by diode reference D2. This causes both the input junction and the output junction to approach forward bias and to produce a near zero net voltage difference between collector and ground. When oscillator transistor Q2 clips in the course of the oscillatory cycle, it causes a sharp rise in base current in Q11. This turns on Q11 and its collector current in Q11 exceeds the threshold (0.18 microamperes). When adequate current becomes available, the current source Q15 is drawn out of saturation, and a positive going pulse, reflecting an increase in Q15 collector voltage, is applied to the base of transistor Q13. This pulse activates the Q13, Q14 charging circuit. The Q15 threshold is set to prevent Q11 from generating an output under non-oscillatory conditions.

The charging rate of Q14 is metered in the interests of current economy by the presence of diode D3 in the input of transistor Q13, which derives its current from current reference Q16. The turnaround configuration forces the collector and emitter current in Q13 to mirror the current in diode D3. The actual charging current into capacitor 25 is a function of the product of the current gains of Q11 and Q14 times the base current of Q11, typically ($400 \times I_{b11}$). The capacitor 25 is substantially charged in one or two pulses and within a few seconds.

The dc bias network is responsible for establishing the current drains in each segment of the circuit, for establishing the threshold of the oscillation detector; and enters into maintaining oscillator symmetry in the event that B+ falls.

The primary current reference for the dc bias network comprises PNP transistors Q18, Q20 and the 22 megohm resistance 39. The emitter of Q18, which is the current source of the reference, is coupled to B+, and its collector is coupled through pad 40 and 22 megohm resistor 39 to ground. The collector of Q18 is coupled to the base of PNP transistor Q20, which is a buffer for supplying base current to Q18 and the other secondary current sources. The emitter of Q20 is coupled to the base of Q18, Q3, Q17 for this purpose. The collector of Q20 is connected to ground to complete the current path. In this configuration, the buffer Q20 supplies base current to the controlled transistors with minimum ($1/\beta^2$) current diversion from the collector of Q18. A second feature of the configuration is that the connection of the base of Q20 to the pad 40 insures that the voltage applied to resistance 39 is quite stable, being held equal to the B+ bias voltage less the voltage drops of two input junctions($V_{be\,18}$, $V_{be\,20}$).

The reference current is accordingly:

$$I_{ref} = \frac{B+ - 2(V_{be})}{22_1 \times 10^6}$$

In the dc bias network, the primary reference Q18 establishes the current level (0.36 microamperes) in the current source Q3 for the Q1, Q5 amplifier stages; the current level (0.036 microamperes) in the current source Q19, controlling a subsidiary source Q12 at one half the current of Q19, and supplying current to the amplifier stages Q2, Q4; and finally the current level in the current source Q17 establishing two 0.18 microampere current levels in the oscillation detector circuit. In addition, the dc bias network is adjusted to provide centering of the oscillator. The point to be centered is the collector connection of Q2 at pad 36. As noted above, the current established at the emitter of Q2 is 0.018 microamperes. This current is set by resistance 39 (22 megohms) and the B+ bias less two diode drops, and then divided in two by the unity geometry ratio of D1, Q12. Resistance 32 is set at 26 megohms, a value calculated to produce a voltage drop at approximately one-half the B+ voltage at the indicated current levels. The arrangement makes the center voltage a function of the ratio of these two resistances primarily, allowing it to retain the same proportionality of the total voltage, in spite of changes in value.

The FIG. 4 embodiment is designed for integrated circuit processing in which all diodes and transistors are integrated on a single chip using a conventional bipolar process. Because of the wide range in resistances, no resistors are integrated except for R22, which may be used for temperature compensation. None of the capacitors are integrated.

Figure 5:
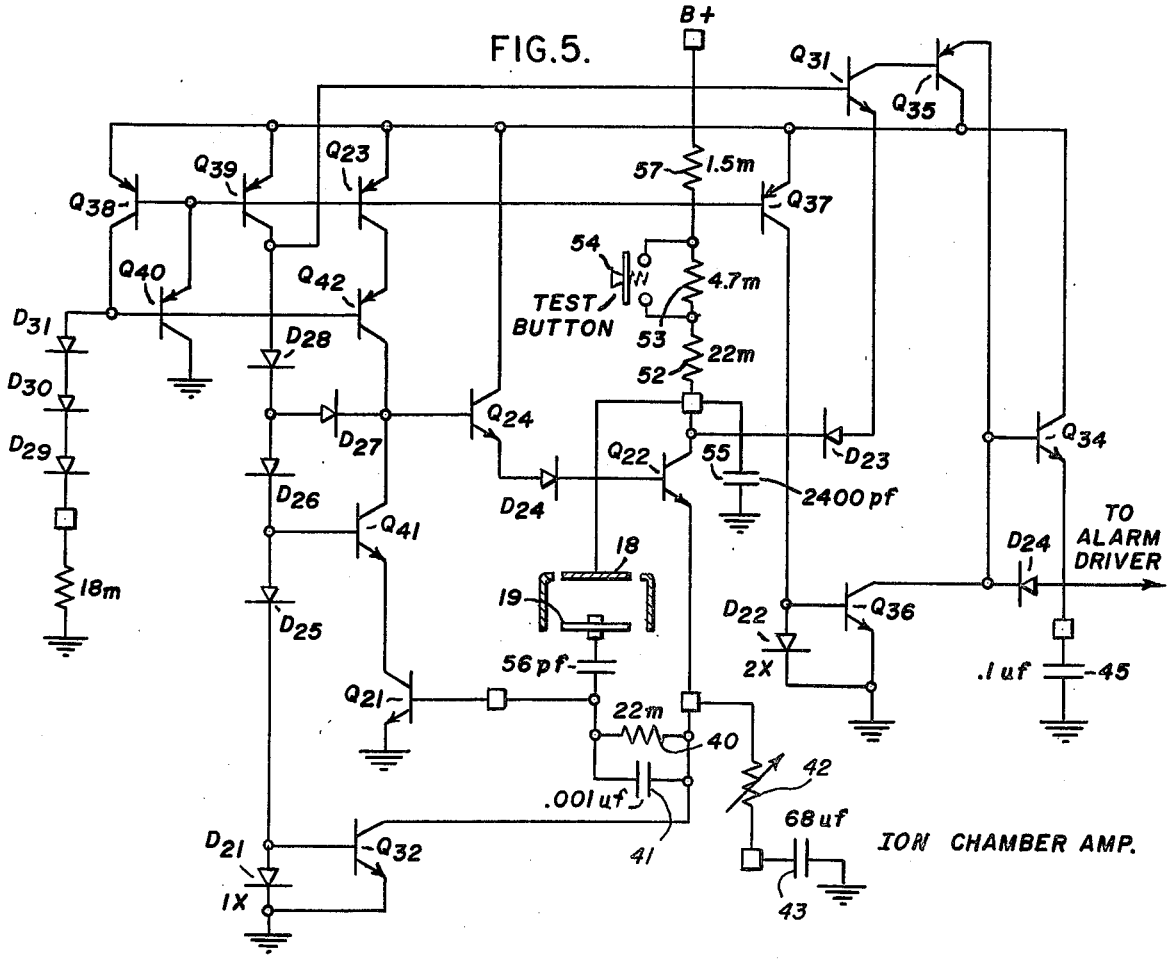
FIG. 5 is an illustration of a second embodiment of the invention showing the electrical circuit details.

A second practical embodiment of the invention is shown in FIG. 5. The arrangement is modified over the FIG. 4 embodiment, both in respect to the sensor oscillator and the oscillation detector. In also is designed for integrated circuit fabriction.

The sensor oscillator in the FIG. 5 embodiment has greater gain and greater immunity to leakage (i.e., from the collector to the base of the input transistor) than in the FIG. 4 embodiment. These advantages flow from use of a cascoded input stage. The forward gain path of the sensor oscilltor comprises the transistors Q21, Q41, Q24 and Q22. Transistors Q21 and Q41 are connected in cascode with the signal input being applied in the base of Q21. The emitter of Q21 is grounded, the collector of Q21 is coupled to the emitter of Q41; and the collector of Q41, from which the signal output is derived, is coupled to a current source comprising transistors Q23 and Q42. In the FIG. 4 embodiment, small amounts of collector to base leakage current in Q1 may be present, and if present, are applied to the base of Q5. When applied to the base of the next gain stage, the leakage current is multiplied by the $\beta(\sim 200)$ of that stage, where it has a strong effect on the second stage output current. In the FIG. 5 embodiment, the leakage may also be present, but is coupled to the emitter of the cascoded upper stage Q41. When applied to the emitter, the current multiplication is near unity, and does not significantly affect the output current of the cascoded stage.

The bias network for the cascoded oscillator stage includes a clamp to avoid collector current injection into the substrate from saturation of the upper stage. The input junction of the lower stage Q21 of the cascoded stage is forward biased at a very tiny (subnonoampere) base current as explained in connection with the FIG. 1 embodiment. The base of the upper stage (Q41) is maintained at two diode drops above ground by connection into a series chain of four forward biased diodes D21, D25, D26, D28. The diodes are maintained in a forward biased state by current supplied from a secondary current source (transistor Q39). The collector of transistor Q39 is coupled to the anode of diode D28, the first diode in the chain. The cathode of D28 is coupled to the anode of diode D26, the second diode in the chain. The cathode of D26 is coupled to the anode of D25, the third diode in the chain. The cathode of diode D25 is coupled to the anodeof diode D21, the fourth and last diode in the chain, whose cathode is grounded. The base of transistor Q41 is coupled into the diode chain at the connection of diode D26 to diode D25, thus fixing its base potential at two diode drops above ground. Another diode D27 is provided to complete the clamp. The anode of diode D27 is coupled to the anode of D26 and its cathode is coupled to the collector of Q41. Diodes D26 and D27 act as a clamp to prevent the collector voltage of Q41 from falling below the voltage at the base of Q41, and thus prevent current injection into the substrate should Q41 be driven toward saturation.

The current source for the cascoded oscillator input stage is itself cascoded to maintain its high impedance condition in relation to the impedance of the cascoded input stage for maximum amplifier gain. The cascoded current source comprises the transistors Q23 and Q42. Transistor Q23 is a PNP transistor having its emitter coupled to the B+ bus and its base coupled to the base bus shared by the other secondary current sources (Q39, Q37). The collector of transistor Q23 is coupled to the emitter of PNP transistor Q42 for cascoding. Transistor Q42 is maintained in a forward biased condition by connection of its base to the collector of Q38, the primary current reference. The collector of current source transistor Q42 is coupled to the collector of cascoded amplifier transistor Q41 for supplying current to the cascoded amplifier.

The cascoded current source is designed to have a suitably high impedance for maximum gain operation of the cascoded oscillator input stage. By definition, a current source has internal impedance which is large relative to the impedance of an external load so that the current drawn by the load is unaffected by changes in load impedance. In the ideal case, the current source has an infinite internal impedance. While the external load of the current source is the amplifier, the external load of the amplifier is the current source, and the gain of the amplifier is a direct function of its external load impedance. By making the amplifier load approach infinity, assuming no other loading, the gain of the amplifier would approach infinity. In practicee a cascosed amplification stage has an extremely high impedance. This makes it desirable, in the interests of maximum gain, that the current source have the highest possible impedance and dictates cascoding the current source. The cascoded amplifier configuration, when provided with current from the cascoded current supply, has approximately 80 db of gain.

The transistor Q24, diode D24 and transistor Q22 complete the forward gain path of the oscillator with the diode D23 providing a clamp for preventing saturation of transistor Q22. The signal output of the cascoded amplifier stage is coupled to the base of emitter follower transistor Q24. The collector of Q24 is coupled to the B+ bus and the signal available at the emitter of Q24 is coupled through the forward poled diode D24 to the base of the amplifier transistor Q22. The diode D24 is provided to insure that diode D27 is normally turned off. Transistor Q22 is the last stage of oscillator gain. The collector of Q22, at which the oscillator output appears, is coupled to B+ through a sequence of large valued load resistors 52, 53 and 57. The emitter of Q22 is coupled to the collector of Q32, a secondary current reference, which establishes the emitter current of transistor Q22. The two base input stages (Q24 and Q22) present a high impedance load (typically 400 megohms) to the cascoded input stage. Thus, they largely preserve the 80 db of gain ideally available when the current source is the only load, and contribute additional gain leading to a total gain of about 104 db.

The diode D23 in conjunction with transistors Q21, Q31 and the diode string D21, D25, D26, D28 provides a clamp to transistor Q22 and provides a first threshold in the path of oscillation sensing. The emitter of Q22 is coupled through resistance 40 to the base of Q21 and thus remains at approximately one diode drop above ground. The collector of transistor Q22 is coupled to the cathode of diode D23, whose anode is coupled to the emitter of transistor Q31. The base of Q31 is coupled to the anode of diode D28, four diode drops above ground. Counting down two diode drops (i.e., the input junction of Q31 and D23) from the four diode drops above ground at the anode of diode D23, the collector of Q22 is maintained at two diode drops above ground, or one diode drop above its own emitter. This network acts as a clamp to prevent transistor Q22 from saturating during negative excursions of the output signal and prevents transistor Q22 from latching up due to a parasitic PNP to substrate (which may exist in some IC processes). The clamp becomes active only during the negative portion of the swing, and only if the oscillator is oscillating strongly enough to forward bias diode D23 and the input junction of transistor Q31. This normally occurs when the push-pull swing exceeds approximately 1 volt less than the full B+ voltage. When the inut junction of Q31 is turned on and "clamping", the first oscillation detection threshold is exceeded, and signal current appears at the collector of the transistor Q31. Output current from Q31 is then available to indicate the oscillatory state of the network.

The oscillator feedback networks of the second embodiment are similar to those in the first embodiment. As in the first embodiment, the emitter of oscillator output transistor Q22 is the connection point for the degenerative feedback network. The degenerative feedback network includes the components 40, 41, 42 and 43 whose values are selected for operation at a resonant frequency of approximately 1 Hertz. Paralled resistor 40 and capacitor 41 are coupled between the emitter of Q22 and the base of Q21. Series connected resistor 42 and capacitor 43 are coupled between the emitter of Q22 and ground. The collector of Q22, at which the oscillator signal output appears, is the connection point for the regenerative feedback network. The regenerative feedback network includes the components 52, 53, 54, 55, 56, 57 and the ionization chamber 30. Resistors 52, 53 and 57 are connected in series between the collector of Q22 and the B+ bus and provide the collector load. They are respectively of 22, 4.7 and 1.5 megohms. For circuit test purposes, a normally open SPST push switch 54 shunts the 4.7 megohm resistor. Capacitor 55 is coupled between the collector of Q22 and ground. The ionization chamber 10 has one terminal 18 coupled to the collector of Q22 and its other terminal 19 coupled through capacitor 56 to the base of Q21. The values of the circuit elements 52, 53, 55, 56 and 57 are also selected for oscillation at a resonant frequency of approximately 1 Hertz.

The oscillation detector includes the transistor Q31 (which is also a portion of the oscillator clamp), Q34, Q35, Q36, diodes D22, D24 and the capacitor 45. As in the prior embodiment, the oscillation detector senses when the oscillator stops to initiate an alarm. The FIG. 5 arrangement has two thresholds which must be crossed to give the alarm. The two thresholds together give greater noise immunity to permit greater smoke sensitivity.

The elements in the capacitor charging network are D22, Q36, D24 and capacitor 45. During oscillation, Q22 swings between near B+ and near ground. As the voltage swing nears ground, Q31 which acts like a clamp, and which is normally non-conducting, now becomes conducting as the first threshold is crossed. When this occurs, signal current pulses appear at the collector of Q31, which are applied to the base of PNP transistor Q35. The emitter of Q35 is coupled to the B+ bus and the collector of Q35, supplying amplified signal pulses, is coupled to the base of NPN transistor Q34. Transistor Q34 is the outputt stage of the oscillation detector. The collector of transistor Q34 is coupled to the B+ bus. The emitter of Q34 is coupled to the ungrounded terminal of capacitor 45. Assuming sufficient signal level from the oscillator, Q31 and Q35 turn on Q34 and it supplies signal dependent charging current to the capacitor 45.

The second "threshold" is the threshold between discharge and charge of the capacitor 45 which control the alarm. The second threshold is provided by current source transistor Q36 acting in conjunction with transistor Q37 and diodes D22 and D24. Collector current for transistor Q35 is supplied from the current source transistor Q36, whose emitter is grounded. Current source transistor Q36, whose input junction is paralleled by diode D22, supplies a current estblished by secondary current source Q37 in diode D22. A diode D24 is inserted between the interconnection of the collectors of Q36 and Q35 and the ungrounded terminal of capacitor 45. During normal oscillation, Q34 supplies current pulses through its emitter in a direction to charge up the capacitor 45. During these charging instants, diode D24 is back-biased. During the rest of the time, as well as in the absence of oscillation, Q34 is non-conductive, diode D24 is forward-biased and the capacitor 45 is discharged at a controlled rate through the diode and the current source (Q36). When Q35 is not conducting strongly enough to supply the current setting for current source transistor Q36, transistor Q36 goes into saturation, and the collector voltage of Q36 falls. The voltage drop unblocks (i.e., forward biases) the diode D24 and allows the capacitor to discharge. When pulses are present, there is a comparison between the current stored in capacitor 45 supplied in pulses from Q31, Q35, Q34 and the relatively steady current withdrawn through diode D24 and transistor Q36 at other times. When the current storing exceeds the current withdrawal, the capacitor quickly charges to near B+. When the current storing is less than the current withdrawal, the capacitor discharges to near ground potential. Thus, as in the first embodiment, the current source transistor Q36 sets a virtual threshold, which determines whether capacitor 45 will be near B+ potential, indicating no smoke, or near ground potential, indicating smoke.

Both embodiments permit a vernier on the level of oscillation required to cross the threshold. In general, this allows one to sense an increase in resistance in the ionization chamber in a smaller increment than is required to discriminate between oscillation and non-oscillation, and leads to greater smoke sensitivity. Both arrangements are designed for factory adjustment, to insure that an alarm is given at a prescribed smoke condition. In the FIG. 4 embodiment, this is achieved by adjusting the capacitor 24. In the FIG. 5 embodiment, the capacitor 56 may be adjusted. A small variable air dielectric capacitor between the terminal 19 and ground will also serve this purpose. In both ases, the capacitors may be small and of a type which adjust by deformation of a plate. The threshold may also be adjusted by selection of proper values for resistances 40 or 42 (FIG. 5).

The oscillation frequency has been selected to be approximately 1 hertz, which seems to be a near optimum setting. The frequency may be somewhat higher (2 or 3 hertz) or lower. If the frequency goes higher than 2 or 3 hertz, there may be some loss in sensitivity. At lower frequencies, the alarm mechanism may be delayed longer than necessary.

What is claimed as new and desired to be secured by Letters Patent of the United States is:

1. In a smoke detector network, the combination comprising:

(a) a common network terminal, (b) an ionization smoke detector chamber having a first and a second terminal between which a high impedance exists, said impedance rising when airborne combustion products are present, (c) a sensing circuit for sensing a change in chamber impedance by measurement of the short circuit current through the chamber comprising:

(1) an ac voltage source having one terminal connected to said first chamber terminal and the second terminal connected to said network common terminal, (2) a current amplifier having an input, an output and a common terminal, said amplifier exhibiting an input impedance which is negligibly small in respect to said chamber impedance, said amplifier input terminal being coupled to said second chamber terminal, said amplifier common terminal being coupled to said network common terminal, and having an amplifier load coupled between said amplifier output terminal and said amplifier common terminal in which an amplified ac current appears as an ac voltage whose magnitude is dependent on chamber impedance and in turn on the density of airborne combustion products present, and (3) voltage responsive means coupled to said amplifier output terminal for sensing said density.

2. The combination set forth in claim 1 wherein said current amplifier employs bipolar transistors.

3. The combination set forth in claim 2 wherein said ac source is constituted by said current amplifier having in addition thereto a regenerative feedback network, said amplifier output terminal being connected to said first chamber terminal to couple ac oscillations to said chamber.

4. The combination set forth in claim 3 wherein said chamber is connected in said regenerative feedback network, said feedback network establishing an oscillatory condition when said chamber is in a lower impedance state, corresponding to a low density of airborne combustion products and a non-oscillatory condition when said chamber is in a higher impedance state, corresponding to a predetermined higher density of airborne combustion products.

5. The combination set forth in claim 3 wherein said chamber is connected in said regenerative feedback network, said feedback network oscillating at an arbitrary amplitude when said chamber is in a lower impedance state, corresponding to a low density of airborne combustion products and oscillating at less than said arbitrary amplitude when said chamber is in a higher impedance state, corresponding to a predetermined higher density of airborne combustion products.

6. The combination set forth in claim 5 wherein (1) said current amplifier comprises:

(a) a first transistor in base input, emitter common, collector output configuration, (b) a second transistor whose base input is derived from the collector output of said first transistor, its emitter returned to ground through an ac path including a first impedance ($R_f$), and its collector returned to a bias supply through a second impedance ($R_L$), and wherein (2) said feedback network comprises:

(a) a degenerative feedback path comprising a large valued resistance ($R_i$) coupled between the emitter of said second transistor and the input base of said first transistor, and (b) a regenerative ac feedback path in which said chamber impedance ($R_g$) appears, coupled between the output collector of said second transistor and the input base of said first transistor.

7. The combination set forth in claim 6 wherein (a) sufficient degeneration is provided to make amplifier gain independent of transistor device parameters and, with a high degree of accuracy, dependent on said four impedances: $R_f$, $R_L$, $R_i$ and $R_g$, and wherein (b) said impedances satisfy the following gain establishing relationship:

$$\frac{R_i}{R_g} \times \frac{R_L}{R_f} = 1 + \epsilon$$

where $\epsilon$ is selected to insure an oscillatory condition at said arbitrary amplitude under normal, low impedance conditions.

8. The combination set forth in claim 7 wherein a current source is provided comprising a third transistor having its emitter coupled to said bias supply and its collector supplying collector current to said first transistor and providing a high impedance load to enhance amplifier gain.

9. The combination set forth in claim 8 wherein (a) the collector of said second transistor approaches saturation at one limit of the oscillatory cycle when oscillations reach said arbitrary amplitude to cause a peak in base current, and wherein (b) a fourth transistor is provided as a buffer preceeding said second transistor for enhancing the forward voltage gain, the output of said first transistor being coupled to the base of said fourth transistor, and the emitter of said fourth transistor being connected to the input base of said second transistor for supplying base current thereto.

10. The combination set forth in claim 9 wherein said voltage responsive means are coupled to the collector of said fourth transistor for sensing said oscillatory peaks.

11. The combination set forth in claim 10 wherein a fifth transistor is provided having its base connected to the collector of said first transistor, its collector connected to ground; and its emitter connected to the base of said fourth transistor and to said bias supply through said third transistor, said fifth transistor reducing the amplifier input noise and the base current of said first transistor to the sub-nanoampere range for increased sensitivity.

12. The combination set forth in claim 11 wherein said voltage responsive means comprises:

(a) a capacitor, (b) means for discharging said capacitor at a predetermined rate, (c) means responsive to the output voltage of said fourth transistor for charging said capacitor when oscillation in excess of said arbitrary amplitude occurs, said charging rate exceeding said discharging rate and causing said capacitor voltage to assume a high value under such conditions and a low value in the absence of such conditions, and (d) a voltage sensor coupled to said capacitor for generating a warning signal when said capacitor becomes discharged to said low value.

13. The combination set forth in claim 8 wherein a fourth transistor is provided having its emitter coupled to the collector of said first transistor to provide a cascoded amplification stage, the collector of said fourth transistor from which the output is derived, being coupled to said current source,

14. The combination set forth in claim 13 wherein a fifth transistor is provided having its emitter coupled to the collector of said third transistor to provide a cascoded current source, its collector supplying current to the collector of said fourth transistor and providing a high impedance load to said cascoded amplifier to enhance forward gain.

15. The combination set forth in claim 14 wherein a first clamp circuit is provided comprising two diodes having one pair of like electrodes connected together and the other electrode connected respectively to the base and to the collector of said fourth transistor, said base connected diode being forward biased, said clamp circuit preventing the collector potential of said fourth transistor from falling below the potential of its base to prevent saturation.

16. The combination set forth in claim 15 wherein a sixth transistor is provided as a buffer preceeding said second transistor for enhancing the forward voltage gain, the collector output of said fourth transistor being coupled to the base of said sixth transistor, and the emitter of said sixth transistor being connected to supply base current to said second transistor.

17. The combination set forth in claim 16 wherein a second clamp circuit is provided to prevent saturation of said second transistor comprising a third diode and a seventh transistor, said third diode and the input junction of said seventh transistor being serially connected in the same polarity to a voltage source referenced to the emitter of said second transistor and set to prevent the collector voltage of said second transistor from falling to less than one diode drop above the emitter.

18. The combination set forth in claim 17 wherein said voltage responsive means are coupled to the collector of said seventh transistor for sensing said base current peaks.

19. The combination set forth in claim 18 wherein said voltage responsive means comprises:

(a) a capacitor, (b) means for discharging said capacitor at a predetermined rate, (c) means responsive to the output voltage of said seventh transistor for charging said capacitor when oscillation in excess of said arbitrary amplitude occurs, said charging rate exceeding said discharging rate and causing said capacitor voltage to assume a high value under such conditions and a low value in the absence of such conditions, and (d) a voltage sensor coupled to said capacitor for generating a warning signal when said capacitor becomes discharged to said low value.

* * * * *